US008132552B2

(12) United States Patent
Matsumoto et al.

(10) Patent No.: US 8,132,552 B2
(45) Date of Patent: Mar. 13, 2012

(54) INTAKE DUCT

(75) Inventors: Taketoshi Matsumoto, Hamamatsu (JP); Takahiro Amano, Hamamatsu (JP); Tadayuki Onoda, Hamamatsu (JP)

(73) Assignee: Roki CP., Ltd., Hamamatsu-Shi (JP)

( * ) Notice: Subject to any disclaimer, the term of this patent is extended or adjusted under 35 U.S.C. 154(b) by 367 days.

(21) Appl. No.: 12/436,417

(22) Filed: May 6, 2009

(65) Prior Publication Data

US 2009/0293832 A1 Dec. 3, 2009

(30) Foreign Application Priority Data

Jun. 3, 2008 (JP) ..... 2008-146030

(51) Int. Cl.
*F02M 35/10* (2006.01)
*F01N 1/24* (2006.01)

(52) U.S. Cl. ..... 123/184.61; 181/229; 181/252

(58) Field of Classification Search ..... 123/184.61; 96/108, 153; 181/229, 252, 258
See application file for complete search history.

(56) References Cited

U.S. PATENT DOCUMENTS

| | | | | |
|---|---|---|---|---|
| 6,997,977 | B2 * | 2/2006 | Dallas et al. | 96/153 |
| 7,621,372 | B2 * | 11/2009 | Yamaura et al. | 181/229 |
| 2004/0069146 | A1 * | 4/2004 | Carter et al. | 96/108 |

FOREIGN PATENT DOCUMENTS

| | | | |
|---|---|---|---|
| JP | 2002-106431 | A | 4/2002 |
| JP | 2003-343373 | A | 12/2003 |

* cited by examiner

*Primary Examiner* — Noah Kamen
(74) *Attorney, Agent, or Firm* — Sughrue Mion, PLLC

(57) ABSTRACT

The object of the present invention is to provide an intake duct having waterproof function without increasing parts count.

An intake duct 10 for air intake from the outside to an internal combustion engine E includes a duct wall 11 made of a resin in a tubular form. The duct wall 11 includes a waterproof and humidity-transparent component 20 having a water-repellent layer 21 made of high-density fiber and a waterproof and humidity-transparent layer 22 made of fine porous film laminated to each other.

3 Claims, 4 Drawing Sheets

INTAKE DUCT

FIELD OF THE INVENTION

The present invention relates to an intake duct, and more particularly to an intake duct effective in muffling the intake noise generated at the time of taking air from outside into an internal combustion engine.

BACKGROUND OF THE TECHNOLOGY

As known by prior arts, in addition to the means of providing resonators in an intake path to muffle the noise of a specified range of frequency calculated on the basis of the resonance theory of Helmholtz and others, various types intake ducts have been employed for reducing the intake noise generated in an intake system at the time of taking air from outside into the internal combustion engine such as a gas engine.

According to Patent Document 1, an intake duct has a duct wall, all or a part of which is formed of a porous material having a vent function, and a covering component fitted outside of the duct wall formed of the porous material so as to cover the all or the part of the intake duct with an air layer formed between the duct wall and the covering component.

The intake duct of Patent Document 1 having the above structure allows vibration involved in pressure pulsation in the duct to pass through the duct wall formed of the porous material so as to be let out through the air of the air layer, having the full effect in suppressing the noise generation due to the pressure pulsation in the duct. Further, the porous material member is covered with the component other than the intake duct, which prevents dust and others drifting in the engine room from sticking to the porous material member, lowering the vent function and at the same time prevents water from coming through the porous material member into the intake dust.

According to Patent Document 2, an intake duct is provided with a porous sheet member having a joining portion, with its outer edge portion impregnated with a resin, integrally joined to the intake duct so as to cover an opening formed in a part of the wall of the intake duct.

The intake duct of Patent Document 2 having the structure mentioned above is integrally comprised of a plurality of individual sections, which makes it easy to conduct maintenance operation in the interior of the intake duct by only removing any of the individual sections. In addition, if any part in the individual sections is broken, only the individual section including the broken part has to be changed without changing the intake duct as a whole. Further, the intake duct of Patent Document 2 is manufactured by a method other than blow molding and hence, its components have each a desired thickness even in their differently complicated shapes, which gives a sufficient strength to the structure of the intake duct. Furthermore, the individual sections of the intake duct and the porous sheet member are joined together by the joining portion, which enhances adhesion between them, ensuring reliability of the intake duct as a whole.

[Patent Document 1] Unexamined disclosure No. 2003-343373

[Patent Document 2] Unexamined disclosure No. 2002-106431

DISCLOSURE OF THE INVENTION

Problem to be Solved by the Invention

According to the structures of the conventional intake ducts as mentioned above, the intake duct of Patent Document 1 needs a separate component for the cover, which increases a parts count. Further, sufficient waterproofing should be performed on the fitting portion of the covering component and the intake duct, which has in vain made a success of suppressing the manufacturing cost. On the other hand, the intake duct of Patent Document 2 has never been taken into consideration for waterproofing and hence it might suffer from ill effect on the engine because of water coming from the joining faces of the individual sections to enter into the intake duct.

The present invention has been made in light of the above problem and an object of the present invention is to provide an intake duct whose parts count does not increase and having a waterproof property.

Means for Solving the Problem

According to the present invention, an intake duct has a duct wall made of a resin formed in a tubular shape for taking air from outside to pass it to an internal-combustion engine. The duct wall is provided with a waterproof and humidity-transparent component having a water repellent layer made of high-density-fiber and a waterproof and humidity-transparent layer made of fine porous film laminated to each other.

Further, in the intake duct according to the invention, the waterproof and humidity-transparent component may be arranged so as to close a porous portion formed in the duct wall.

Furthermore, in the intake duct according to the invention, the waterproof and humidity-transparent component is insert-molded in the duct wall.

The above summary of the invention does not represent all the necessary features of the invention but sub-combinations of these features can also be the invention.

EFFECT OF THE INVENTION

Since the intake duct of the invention has a tubular duct wall provided with a waterproof and humidity-transparent layer, it is possible to prevent water coming in the engine room from entering into the intake duct. In addition, thanks to the sound absorption property of the waterproof and humidity-transparent layer made of the fine porous film, it is possible to realize the intake noise reduction.

Further, since the intake duct of the invention has the waterproof and humidity-transparent component provided for closing the porous portion formed in the duct wall, it is possible to reduce the intake noise generated in the intake duct thanks to the waterproof and humidity-transparent layer made of the fine porous film laminated to the inner circumference side of the water repellent layer.

Furthermore, since the intake duct of the invention has the waterproof and humidity-transparent component insert-molded in the duct wall, it is possible to manufacture the intake duct having a waterproof property without increasing its parts count. In addition, it is not necessary to provide another covering component to the outer circumference of the intake duct so that the outer diameter of the intake duct can be made smaller, which may realize downsizing of the intake duct as a whole.

PREFERRED EMBODIMENT FOR CARRYING OUT THE INVENTION

Preferred embodiments will be described below with reference to the drawings. It is to be noted that the following embodiments do not necessarily restrict the invention according to the claims and all the combinations of the features of the invention described in the embodiments cannot be indispensable to the means of solution according to the invention.

FIG. 1 is a schematic view showing an intake path of the internal combustion engine, FIG. 2 is a perspective view of an intake duct according to an embodiment of the invention, FIG. 3 is a perspective view of a half cut duct constituting the intake duct of the embodiment, and FIG. 4 is a sectional view in the radial direction of the half cut duct constituting the intake duct of the embodiment.

As shown in FIG. 1, the intake path of the internal combustion engine includes a resonator 30 connected to the intake duct 10 comprising a tubular duct wall 11, between an intake vent F and an air cleaner 40 of the intake duct. The resonator 30 has a volumetric capacity suitable for reducing the noise of a specified range of frequency calculated on the basis of the resonance theory of Helmholtz. Determining the volumetric capacity to an appropriate value makes it possible to reduce the intake noise generated in the intake path to a desired grade. Further, the intake duct 10 of the embodiment has, as shown in FIG. 1, a waterproof and humidity-transparent component 20 formed on the duct wall 11 at a location nearer to the intake vent F than the resonator 30. Namely, the provision of the waterproof and humidity-transparent component 20 on the duct wall at the near side of the intake vent rather than the resonator 30 enables more effectively the intake noise reduction. It is to be noted that the structure of the intake duct may dispense with the resonator 30 if the waterproof and humidity-transparent component 20 can function by itself to sufficiently reduce the intake noise.

Next, with reference to FIGS. 2 and 3 will be explained the intake duct 10 of the embodiment. As shown in FIG. 2, the intake duct 10 of the embodiment has the duct wall 11 made of a resin in a tubular form. In addition, the duct wall 11 has a portion formed by a lattice frame 12 and hence has a pore portion 13 including a plurality of pores provided in the duct wall 11. Then the pore portion 13 is closed by the waterproof and humidity-transparent component 20, which is provided by insert molding in the intake duct in order to cover the pore portion. Thus, the manner of insert-molding the waterproof and humidity-transparent component 20 in the dust wall 11 makes it possible to prevent the invasion of water into the inside of the intake duct 10 from the outside thereof without using another covering component and make the outer diameter of the intake duct 10 smaller. Incidentally, while in this embodiment the explanation has referred to the case where the waterproof and humidity-transparent component 20 is insert-molded in the duct wall 11, a case may also be favorable where the waterproof and humidity-transparent component 20 is wound around an outer peripheral surface of the intake duct 10 so as to cover the pore portion 13.

As shown in FIG. 3, the duct wall 11, in which the waterproof and humidity-transparent component 20 is insert-molded, comprises half-cut ducts 10*a* and 10*a* confronted with each other to be joined as the intake duct 10. Such manner of forming the wall duct 11 composed of the half-cut ducts makes easy the insert molding of the waterproof and humidity-transparent component 20 in the duct wall 11. Further, as shown in FIG. 2, both ends of the half-cut ducts 10*a* in the intake direction are respectively joined to an engine side duct 14 and an intake side duct 15 so as to be the single intake duct. As the joining manner, general welding for use in resin forming such as vibration welding, hot welding, and ultrasonic welding may be applicable other than solvent welding by adhesives and bolt joining.

The number of the pores 13 and an open area of the pore may be determined appropriately in consideration of a noise reduction capacity of a water and humidity-transparent layer 22 of the waterproof and humidity-transparent component 20 has. Furthermore, while the explanation of the intake duct 10 in this embodiment has referred to the case where the pore portion 13 is provided with the duct wall 11 formed by the lattice frame 12, another case may be preferable where the duct wall 11 is provided with a plurality of pores in a punching metal form or the duct wall is formed by a mesh material.

Next, referring to FIG. 4, the structure of the waterproof and humidity-transparent component 20 will be explained. The waterproof and humidity-transparent component 20 comprises a water-repellent layer 21 made of a high-density fiber and a humidity-transparent layer 22 made of a fine porous film laminated to each other, the water-repellent layer 21 being disposed on the outer peripheral surface side of the half-cut duct 10*a* and a waterproof and humidity-transparent layer 22 being disposed on the inner peripheral surface side of the half-cut duct 10*a*.

Since the water repellent layer 21 is made of a high-density fiber of polyester, it is possible to protect the waterproof and humidity-transparent layer 22 laminated on the inner surface of the water repellent layer 21 from the outside.

The waterproof and humidity-transparent layer 22 is made of a fine porous film of polyurethane with a plurality of pores. The waterproof and humidity-transparent layer 22 is formed in a manner of blowing polyurethane to the water repellent layer 21 mentioned above. Further, the diameters of the plurality of pores formed in the waterproof and humidity-transparent layer 22 are determined such that as shown in FIG. 4, the pores have diameters of 0.5 to 3 μm in the outermost area 22*a* and have gradually larger diameters from the outermost area 22*a* toward the innermost area 22*b*. The waterproof and humidity-transparent layer 22 has a density gradient from the outermost area 22*a* toward the innermost area 22*b*.

The intake noise generated due to the air intake is absorbed by the innermost area 22*b* of the waterproof and humidity-transparent layer 22 formed with the larger diameter pores so that the intake noise can be reduced. It is to be noted that the sizes of the pores and the number of the pores formed in the innermost area 22*b* of the waterproof and humidity-transparent layer 22 may be determined appropriately in consideration of levels of the intake noise, frequency and others. Further, it may be preferable in order to enhance the noise absorbing effect to bond a sound-absorbent material like bonded fabric onto the inner side of the waterproof and humidity-transparent layer 22.

As mentioned above, since the outermost area 22*a* of the waterproof and humidity-transparent layer 22 has the pores of 0.5 to 3 μm in diameter, it is possible to prevent the water invading in the engine room from further invading into the intake duct.

The intake duct 10 provided with the waterproof and humidity-transparent component 20 having the above structure can prevent the water invading in the engine room from further invading into the intake duct, while reducing the intake noise thanks to the waterproof and humidity-transparent layer 22 of the waterproof and humidity-transparent component 20. Further, since the intake duct 10 of the embodiment dispenses with another covering component, it is possible to slim down the cost, to manufacture the intake duct 10 at low cost, select the outer diameter of the intake duct 10, and realize downsizing of the intake duct 10.

In this embodiment, while the case is explained where the water repellent layer 21 is made of polyester and the waterproof and humidity-transparent layer 22 is made of polyurethane, the water repellent layer and the waterproof and humidity-transparent layer may not be limited to these materials. Further, in this embodiment, while the waterproof and humidity-transparent layer 22 has a density-gradient from the outermost area 22*a* toward the innermost area 22*b*, and the diameter range of the pores in the outermost area is of 0.5 to 3 μm effective in stopping the water invasion, it is preferable to conduct waterproofing on the outermost area and form the waterproof and humidity-transparent layer. It is apparent from the patent claims that other embodiments provided with such modifications and improvements can be included as far as the field of the technology of the present invention.

EXPLANATION OF REFERENCE NUMERALS

Figure 1:
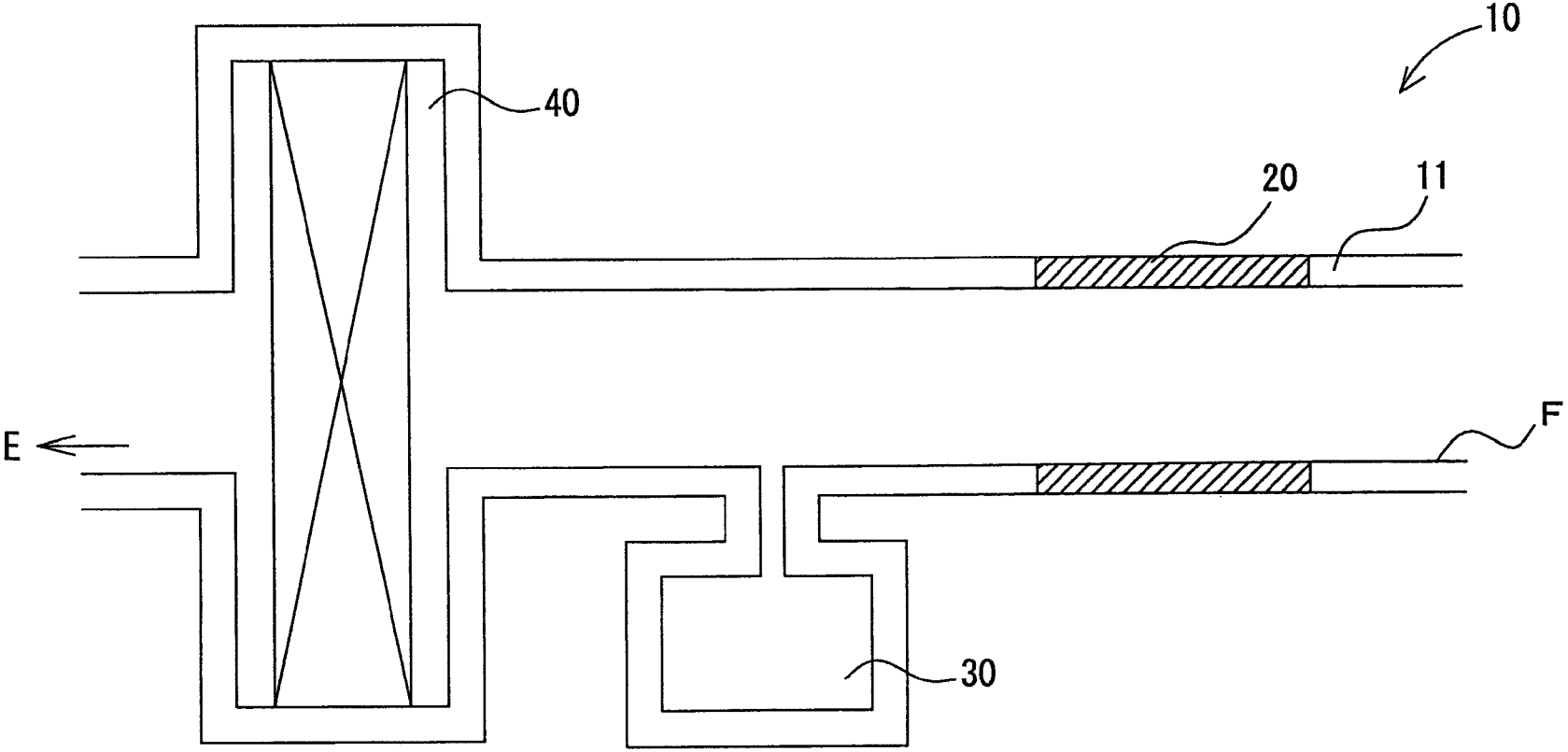
FIG. 1 is a schematic view showing an intake path of the internal combustion engine.
Figure 2:
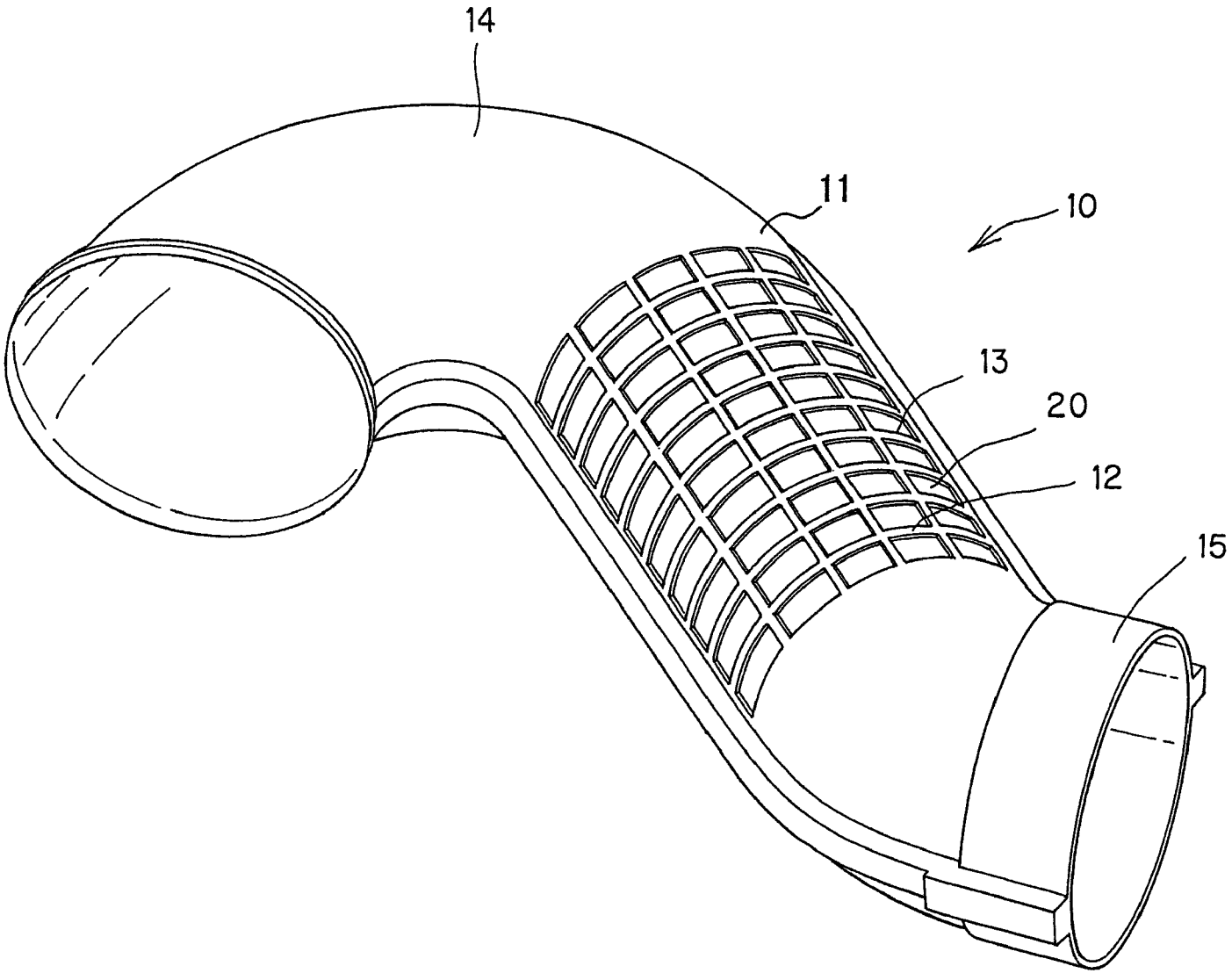
FIG. 2 is a perspective view of an intake duct according to an embodiment of the invention.
Figure 3:
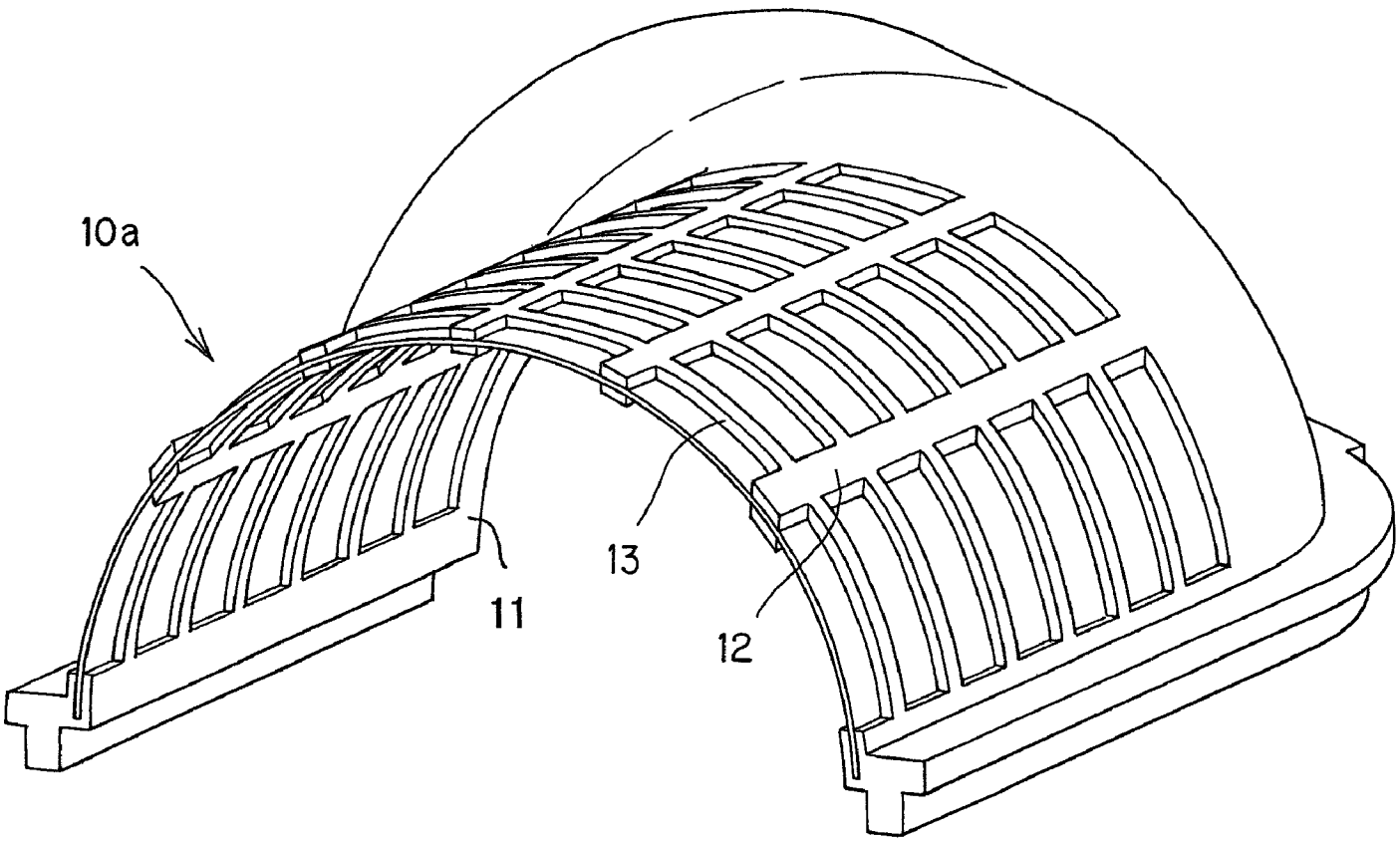
FIG. 3 is a perspective view of a half cut duct constituting the intake duct of the embodiment.
Figure 4:
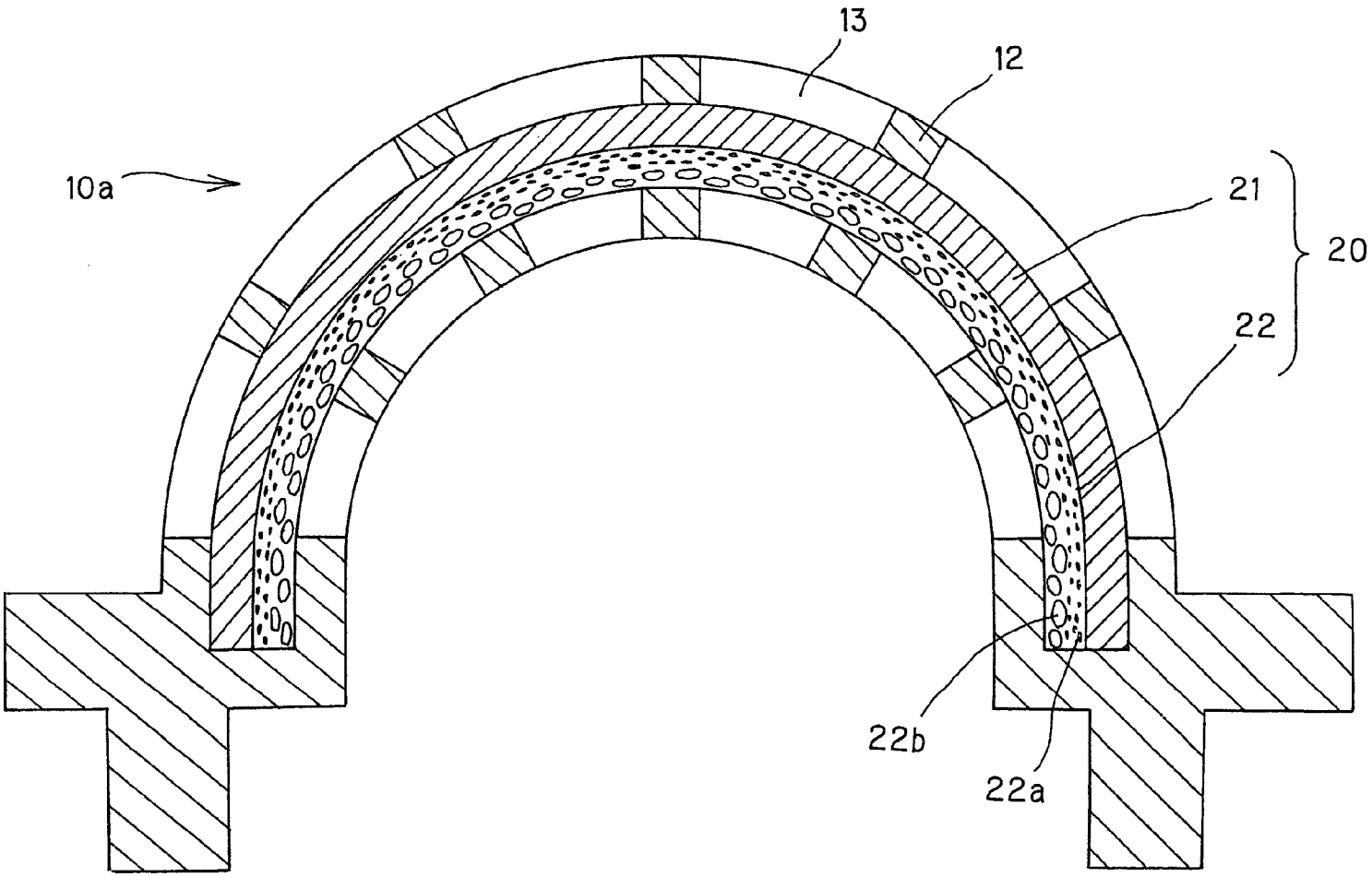
FIG. 4 is a sectional view in the radial direction of the half cut duct constituting the intake duct of the embodiment.

10: intake duct
10*a*: half cut duct
11: duct wall
12: frame
13: pore portion
14: engine side duct
15: intake side duct
20: waterproof and humidity-transparent component
21: water-repellent layer
22: waterproof and humidity-transparent layer
22*a*: outermost area
22*b*: innermost area
30: resonator
40: air cleaner
E: internal combustion engine
F: intake vent

CROSS-REFERENCE TO RELATED APPLICATIONS

This application is based upon and claims the benefit of priority from Japanese Patent Application No. 2008-146030 filed on Jun. 3, 2008; the entire contents of which are incorporated herein by reference.

What is claimed is:

1. An intake duct having;

a duct wall made of a resin formed in a tubular shape for guiding air from outside to an internal-combustion engine, wherein said duct wall is provided with a waterproof and humidity-transparent component having a water repellent layer made of high-density-fiber and a waterproof and humidity-transparent layer made of fine porous film laminated to each other, and wherein said waterproof and humidity-transparent layer has a density gradient from an outermost area toward an innermost area.

2. The intake duct according to claim 1, wherein said waterproof and humidity-transparent component is arranged so as to close a porous portion provided in said duct wall.

3. The intake duct according to claim 1 or 2, wherein said waterproof and humidity-transparent component is provided in said duct wall by insert-molding.

* * * * *